United States Patent [19]

Farian

[11] 4,441,644

[45] Apr. 10, 1984

[54] BUFFER SYSTEM FOR FASTENER DRIVING DEVICES

[75] Inventor: Gerhard Farian, Grossbettlingen, Fed. Rep. of Germany

[73] Assignee: Karl M. Reich Maschinenfabrik GmbH, Nuertingen, Fed. Rep. of Germany

[21] Appl. No.: 326,194

[22] Filed: Dec. 1, 1981

[30] Foreign Application Priority Data

Dec. 18, 1980 [DE] Fed. Rep. of Germany ..... 3047662

[51] Int. Cl.[3] ..... B25C 1/04

[52] U.S. Cl. ..... 227/130; 92/85 R; 173/139; 188/322.11

[58] Field of Search ..... 173/139; 227/130; 188/322.11, 322.22; 92/85 R

[56] References Cited

U.S. PATENT DOCUMENTS

| | | | |
|---|---|---|---|
| 3,496,840 | 2/1970 | Wandel et al. | 227/130 X |
| 3,583,496 | 6/1971 | Fehrs | 227/130 X |
| 3,969,989 | 7/1976 | Maurer et al. | 227/130 X |
| 4,053,093 | 10/1977 | Thueringer | 227/130 X |
| 4,320,864 | 3/1982 | Novak et al. | 227/130 |

FOREIGN PATENT DOCUMENTS

| | | | |
|---|---|---|---|
| 2122775 | 7/1973 | Fed. Rep. of Germany | 227/130 |
| 2510858 | 9/1976 | Fed. Rep. of Germany | 227/130 |
| 2529873 | 1/1977 | Fed. Rep. of Germany | 227/130 |

*Primary Examiner*—Frank T. Yost

*Attorney, Agent, or Firm*—W. G. Fasse; D. H. Kane, Jr.

[57] ABSTRACT

The present buffer system for a fastener driving device includes two cooperating buffer elements (16, 22) located at the bottom (17) of the driving cylinder (2). A first buffer element (16) of hard elastic material rests on the inwardly facing surface of the cylinder bottom (17) in such a manner that at least a portion of the surface (18) of the first buffer element (16) contacting the bottom (17) is movable relative to the bottom (17) of the driving cylinder (2). A second buffer element (22) made of an elastic material softer than the hard elastic material of the first buffer element, rests on the first buffer element.

7 Claims, 2 Drawing Figures

BUFFER SYSTEM FOR FASTENER DRIVING DEVICES

CROSS-REFERENCE TO RELATED APPLICATION

Figure 1:
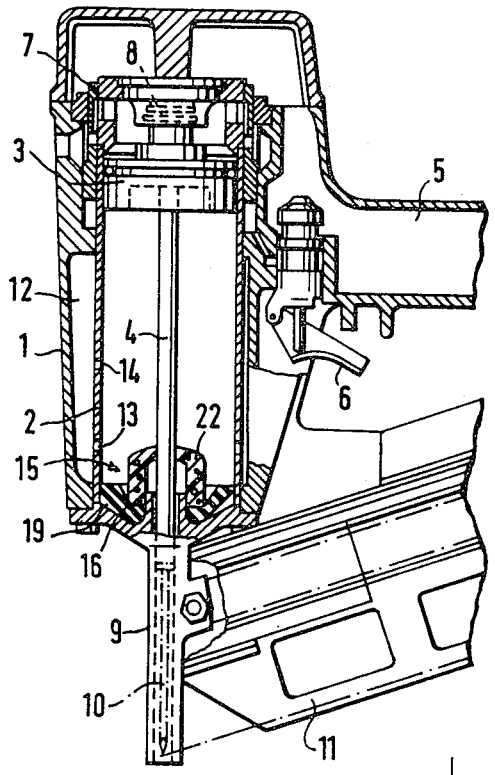

The present application is based on German Ser. No. P 3,047,662.1, filed in the Federal Republic of Germany on Dec. 18, 1980. The priority of the German filing date is claimed for the present application.

BACKGROUND OF THE INVENTION

The present invention relates to a buffer system for fastener driving devices. Such devices drive, for example, nails or the like by means of a driver piston which is guided in a cylinder and activated by pressurized air.

German Pat. (DE-PS) No. 2,339,163 corresponding to U.S. Pat. No. 3,969,989 discloses a driving device for driving nails or the like which is equipped with a buffer system including a relatively soft buffer element made of a material, the volume of which is compressible.

The buffer system further comprises a hard buffer element cooperating with the soft buffer element. The hard buffer element is resting with its entire contact surface on the bottom of the lower end or foot of the cylinder.

This prior art buffer system is capable to safely take up impacts having excess pressure as well as idle impacts while having a high useful life. However, due to the contact between the hard buffer element and the bottom of the cylinder foot, each impact generates an unpleasant body noise which is a nuisance to the operator. Under extreme conditions the buffer element may be subject to a substantial deformation, whereby the buffer elements may be damaged due to inner friction and heat up.

OBJECTS OF THE INVENTION

In view of the above it is the aim of the invention to achieve the following objects singly or in combination:

to provide a buffer system of the type described which is capable to safely take up and dissipate the excess impact energy while keeping the body noise as small as possible and while simultaneously having a useful life as long as possible;

to construct the buffer system in such a manner that a friction stage, so to speak, is operatively effective between a buffer element of soft material, and a buffer element of hard material;

to assure an efficient heat dissipation in a buffer system of the invention;

to arrange the buffer system in such a manner that a change in its operational noise provides an indication that it needs to be replaced; and to make sure that the noise is minimized, including the noise caused by the escaping pressurized air during the return stroke of the driving piston.

SUMMARY OF THE INVENTION

According to the invention there is provided a buffer system for fastener driving devices which comprises at least two buffer elements made of a hard elastic buffer material and a soft elastic buffer material. The two buffer elements are arranged in the impact facing end of the driving cylinder and cooperate with each other for taking up and dissipating excess impact energy of the driving piston. The arrangement is such, that the buffer element of hard elastic material is provided with a contact surface, at least a portion of which is in movable contact with the bottom of the cylinder formed by the inwardly facing surface of the cylinder foot. In the normal condition of the hard material buffer element, when it is not subject to an impact, a spacing is provided between a portion of the contact surface of the hard buffer element and the inwardly facing surface of the cylinder foot.

The movable arrangement of the hard buffer element constitutes the interposition of a friction stage between the soft spring characteristic of the soft buffer element and the hard spring characteristic of the hard buffer element. During normal nailing operations when there is little excess pressure, only the soft portion of the combined spring characteristic is utilized. The hard portion of the spring characteristic becomes effective, for example, when idle strokes are performed. This type of structure has resulted in a noticeable reduction of the body noise during normal nailing operations. Reductions up to six dB have been measured which means that the noise generation has been reduced to about one half of the noise generated by a comparable prior art structure.

According to an advantageous embodiment the hard buffer element is arranged in the cylinder with a biasing load so that the hard element is pressed with an even larger force against the inner surface of the cylinder ring surrounding the hard buffer element when the soft buffer element is compressed by an impact stroke. Thus, upon further compression the excess impact energy is dissipated by friction at the contact surfaces between the hard buffer element and the cylinder foot or between the hard buffer element and the inner surface of the cylinder or cylinder ring surrounding the hard buffer element. This cooperation between the contacting surfaces also provides for an efficient heat dissipation or heat removal.

According to the invention the hard buffer element during its normal operation is thus not fully in contact with the inner surface of the cylinder foot. However, if the hard buffer element comes into contact with the inner surface of the cylinder foot then the hard buffer element operates as a hard, deformable buffer which is heated substantially due to inner friction. This inner friction may, however, also cause the destruction of the hard buffer element, as in the prior art. However, when in the apparatus according to the invention the hard buffer element rests entirely against the inwardly facing surface of the cylinder foot, the body noise is increased, whereby the operator receives a signal that the replacement of the hard buffer element is necessary. Thus, the invention has the advantage that a damage or destruction of parts of the driving device is avoided with certainty.

If the present buffer system is used in a driving device equipped in a known manner with an air storage for storing the pressurized air required for the return stroke of the piston, the present buffer system has the further advantage that the pressurized air escapes only slowly during the return stroke of the driving piston, whereby such escape from the driving cylinder is less noisy. This is so because the soft buffer element rests on the hard buffer element and thus the soft buffer element substantially reduces the cross-sectional area of the venting opening for the escaping air.

BRIEF FIGURE DESCRIPTION

Figure 2:
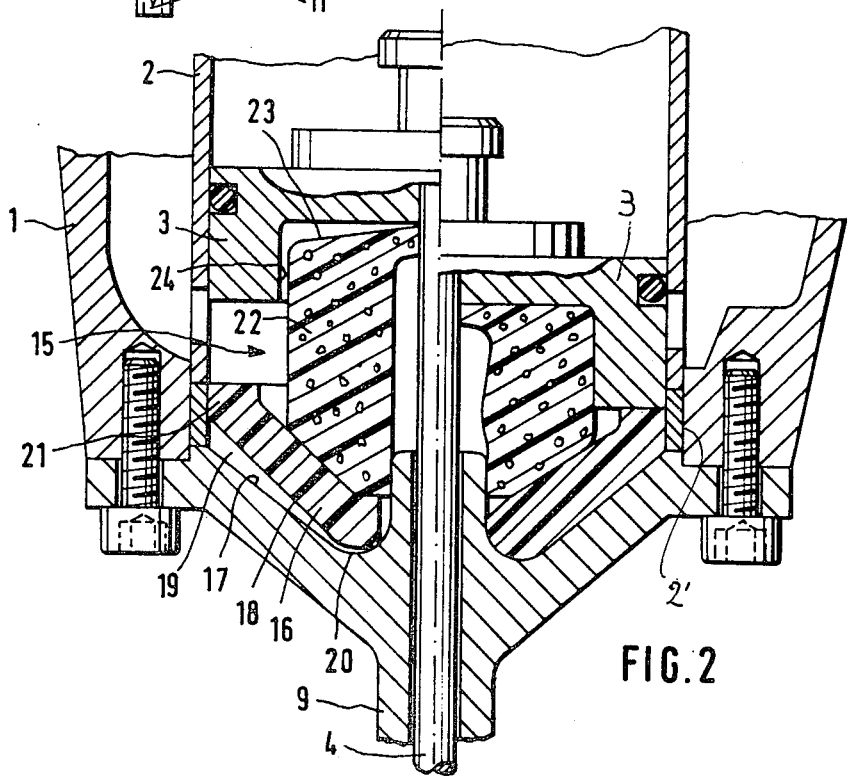

In order that the invention may be clearly understood, it will now be described, by way of example, with reference to the accompanying drawings, wherein:

FIG. 1 is a longitudinal sectional view through a fastener driving apparatus equipped with a buffer system according to the invention; and FIG. 2 is a sectional view, on an enlarged scale, through the lower portion of the driver apparatus showing the details of the buffer system, whereby the left-hand portion shows the unloaded condition of the buffer system while the right-hand portion shows the loaded position of the buffer system.

DETAILED DESCRIPTION OF PREFERRED EXAMPLE EMBODIMENTS AND OF THE BEST MODE OF THE INVENTION

FIG. 1 shows an axial, longitudinal sectional view through a fastener driver which is only partially shown. The driver for nails or the like comprises a housing 1 in which a driver cylinder 2 is arranged for guiding a driver piston 3 equipped with an impact rod 4 displaceably supported in the cylinder. Air under pressure is supplied to the driver apparatus through the handle 5 from a pressurized air source not shown. The pressurized air travels into the inner space of the cylinder 2 in response to the operation of a trigger lever 6 and in response to actuation of a tubular valve slide 7. The pressurized air in the cylinder 2 above the piston 3 accelerates the driving piston 3 in the direction toward the cylinder foot 9 when the cylinder is released by its elastic click mechanism 8. As a result of the acceleration of the piston 3 the impact rod 4 drives the nail 10 into a work piece not shown. Further nails are held ready by a magazine 11.

The cylinder 2 is surrounded by an air storage space 12 which is filled with air under pressure through openings 13 and 14 in the cylinder 2 during the driving stroke in a known manner. This pressurized air is effective on the underside or surface of the driving piston 3 when the trigger lever 6 is released, whereby the driving piston 3 is again moved into the starting position.

When the driving piston 3 reaches the lower limit of its driving stroke it impacts on a buffer system 15 shown on an enlarged scale in FIG. 2. The buffer system 15 comprises a first buffer element 16 made of a hard elastic material which suitably may be cross-linked polyurethane. The contact surface 18 of the buffer element 16 facing the conical bottom 17 of the cylinder foot 9 has also a frustum shape. However, the cone angle of the contact surface 18 is smaller than the cone angle of the upwardly facing inner surface 17 of the cylinder foot 9. Thus, when the buffer system is not subject to an impact an intermediate space 19 is formed between the surface 17 and the contact surface 18 as shown in the left-hand portion of FIG. 2. However, when the buffer system is subject to an impact as shown in the right-hand portion of FIG. 2, the surfaces 17 and 18 contact each other, whereby the space 19 disappears.

The buffer element 16 further comprises a cylindrical section 21, the outer diameter of which is somewhat larger than the inner diameter of the cylinder 2 and also larger than the inner diameter of the lower end ring 2' of the cylinder 2. Thus, the buffer element 16 is held in the cylinder with a biasing which has the above mentioned advantage that additional buffering is accomplished by the friction between the outer surface of the cylinder portion 21 and the inner surface of the cylinder 2 and that the resulting frictional heat is efficiently dissipated.

A second buffer element 22 rests on the first buffer element 16 and faces the driving piston 3. The second buffer element 22 is preferably made out of a cellular material such as polyurethane elastomer. Such cellular structure provides in a known manner a progressive spring characteristic for the buffer element 22. The upwardly facing surface 23 of the buffer element 22 is also slanting slightly radially outwardly relative to the longitudinal central axis. The downwardly facing surface of the driving piston 3 is provided with a cylindrical recess 24, the inner diameter of which is larger than the outer diameter of the buffer element 22.

As mentioned, the left half of FIG. 2 shows the buffer system 15 when it is not subject to any loading. However, the impact or driving piston 3 is in a position just about contacting the second buffer element 22. At this point the intermediate space 19 between the bottom surface 17 and the contact surface 18 is still fully present. For dissipating any excess driving energy the buffer system 15 is compressed as illustrated in the right-hand portion of FIG. 2. During this compression the first buffer element 16 is spread out by the compaction of the second buffer element 22, whereby the cylindrical section 21 of the first buffer element 16 is pressed radially outwardly against the cylinder 2, 2' said radial outward pressing exceeding the radially outward biasing of the ring portion 21 of the buffer element 16. As further braking action is applied to the driving or striking piston 3, the cylindrical section 22 is displaced relative to the inner cylinder surface of the cylinder 2, 2' and portions of the contact surface 18 of the buffer 16 are shifted against the inner bottom surface 20, whereby a substantial friction is generated. The resulting energy is dissipated in the form of heat. Since the components surrounding the buffer system are metal components such as the cylinder 2 and the cylinder foot 9, an efficient heat dissipation is accomplished.

If the contact surface 18 rests completely against the bottom surface 17, then the first buffer element 16 acts in the same manner as a respective prior art element, namely, as a hard buffer which is able to take up still further excess driving energy as a result of its inner deformation.

During the just described friction phase of the buffer system 15 very little body noise is generated while the buffer elements are substantially protected against destruction. When after a certain period of operation the buffer elements have been exposed, nevertheless, to a certain wear and tear, the resulting body noise is increased and the operator is thereby informed, that the buffer elements require replacement.

Although the invention has been described with reference to specific example embodiments, it will be appreciated that it is intended to cover all modifications and equivalents within the scope of the appended claims.

What is claimed is:

1. A buffer system for fastener driving devices having a driving piston guided in a driving cylinder and operated by air under pressure, comprising a first buffer element (16) having a radially inner portion resting on a bottom surface (20) of said driving cylinder (2), a second buffer element (22) arranged for cooperation with said first buffer element for performing a damping function, said first and second buffer elements being made of materials having different hardnesses such that the first buffer element is made of a hard elastic material while the second buffer element is made of a relatively soft elastic material, said first buffer element (16) further having a radially intermediate portion including a surface area (18) normally spaced from said bottom surface of said driving cylinder for normally providing a spacing (19) between said surface area (18) of said first buffer element (16) and said bottom surface of the driving cylinder, at least a part of said intermediate portion of said surface area of said first buffer element being arranged to be movable relative to said bottom surface of said driving cylinder, said first buffer element further having a radially outer portion (21) resting with a radially outwardly directed bias force against an inner surface of said driving cylinder above said bottom surface to provide for said spacing, wherein said first buffer element (16) performs its damping function in two phases, so that, in response to an impact by said driving piston on said second buffer element (22), the first buffer element first causes energy dissipation by friction between said radially outer portion (21) and said inner surface of said driving cylinder until said spacing (19) disappears whereupon the first buffer element causes further energy dissipation as a result of its inner deformation.

2. The buffer system of claim 1, wherein said first buffer element (16) has the shape of a frustum, and wherein said bottom surface (20) of said driving cylinder (2) has a substantially conical shape on which said frustum normally rests at least partially with said radially inner portions to provide said spacing as long as there is no impact on said second buffer element.

3. The buffer system of claim 2, wherein said frustum forming said first buffer element (16) has a given cone angle and wherein said conical shape of said bottom (17) has a cone angle which is larger than said given cone angle of said frustum to provide said spacing.

4. The buffer system of claim 1, wherein said driving cylinder (2) has a given inner diameter, said radially outer portion (21) of said first buffer element (16) having a substantially cylindrical shape with a diameter larger than said given inner diameter of said driving cylinder, whereby said cylindrical shape of said radially outer portion of the first buffer element (16) rests with said bias force against the driving cylinder, said bias force being effective substantially radially outwardly.

5. The buffer system of claim 1, wherein said second buffer element (22) rests on said first buffer element (16).

6. The buffer system of claim 5, wherein said driving piston has a downwardly open recess (24) having a given inner diameter, said second buffer element (22) having a substantially cylindrical shape with an outer diameter smaller than said given inner diameter of said recess (24).

7. The buffer system of claim 6, wherein said second buffer element (22) has a top surface (23) facing toward said recess (24) in said driving piston, said top surface (23) slanting substantially radially outwardly and downwardly.

* * * * *